United States Patent [19]

Goldner

[11] Patent Number: 4,685,374

[45] Date of Patent: Aug. 11, 1987

[54] PAGE TURNING APPARATUS AND METHOD

[76] Inventor: Richard Goldner, 3717 Toad Lake Rd., Bellingham, Wash. 98226

[21] Appl. No.: 704,473

[22] Filed: Feb. 22, 1985

Related U.S. Application Data

[63] Continuation-in-part of Ser. No. 544,699, Oct. 24, 1983, Pat. No. 4,553,467.

[51] Int. Cl.[4] ..... G10G 7/00

[52] U.S. Cl. ..... 84/487; 84/505; 84/506; 40/470; 40/531

[58] Field of Search ..... 84/486-521; 40/470, 531

[56] References Cited

U.S. PATENT DOCUMENTS

| | | | |
|---|---|---|---|
| 1,059,901 | 4/1913 | Neiman. | 84/487 |
| 1,251,169 | 12/1917 | Bagnes | 84/486 |
| 1,397,885 | 11/1921 | Stevens | 84/487 |
| 1,735,166 | 11/1929 | Hossell et al. | 84/486 |
| 2,755,580 | 7/1956 | Justice | 40/531 |
| 2,991,680 | 7/1961 | Elliott | 84/517 |
| 4,121,361 | 10/1978 | D'Arcy | 40/470 |
| 4,432,154 | 2/1984 | D'Arcy | 40/531 |
| 4,463,651 | 8/1984 | Hammer | 84/504 |
| 4,553,467 | 11/1985 | Goldner | 84/505 X |

*Primary Examiner*—Benjamin R. Fuller

*Attorney, Agent, or Firm*—Reed Smith Shaw & McClay

[57] ABSTRACT

A page turning device is provided in which a first elongated arm is rotatably mounted for circular motion substantially parallel to but above the plane of the volume. A page lifting facility cooperates with the rotation of the first elongated arm to permit the first elongated arm to rotate between a lifted upper leaf and the remainder of the leaves of the volume. Continued rotation of the first elongated arm turns the upper leaf and positions the arm for turning of the next leaf. In this manner an unlimited number of leaves may be sequentially turned by a mechanically simple device which is immediately ready for use when a volume is positioned thereon.

8 Claims, 13 Drawing Figures

PAGE TURNING APPARATUS AND METHOD

CROSS REFERENCE TO RELATED APPLICATION

This is a continuation-in-part of my copending application Ser. No. 06/544,699, filed Oct. 24, 1983, U.S. Pat. No. 4,553,467.

FIELD OF THE INVENTION

The present invention relates to a device for turning the pages of a book and, in particular, to a device which is adjustable to turning the pages of books, sheet music and the like in a timed cycle or by manual operation.

BACKGROUND OF THE INVENTION

The prior art has long recognized the need for a device to turn the pages of a book, pamphlet and/or the like. The need has arisen from the handicapped as well as from those who need to read material contained in book form while using their hands for other things. A good example of the latter are musicians who must use their hands while reading music.

The prior art has provided a multiplicity of such devices including those disclosed in U.S. Pat. No. 1,059,901; 1,251,169; 1,397,885; 1,735,166; 2,991,680; 4,121,361; 4,432,154; and 4,463,651. Most, if not all, of these devices have proved to be unsuccessful for one or more reasons.

Typical of these devices is a semi-automatic page turner disclosed in U.S. Pat. No. 2,991,680. This device includes a pick-up arm and a page turning arm that rotates on a common shaft. Careful foot lever actuation is required to effect each turning of a page. Any page bulge has to be delicately positioned between pick-up and page turning arms, a step that leaves little room for mechanical maladjustments and an opportunity for failure.

Many of the other devices were unreliable, inconvenient to use or simply not functional. These devices varies from the complex to the simplistic, but regardless of the complexity or lack thereof, they were deficient in one way or another. In fact, the serious deficiences of prior art page turners has become so well known that the public is now skeptical of those who suggest that such a workable device exists or can be made.

Accordingly, there continues to exist a need for a page turner which is functional, reliable, convenient to use and inexpensive. It is, therefore, an object of the present invention to provide such a device.

SUMMARY OF THE INVENTION

The present invention provides a method and apparatus for individually turning the pages of a book or a compilation of pages or leaves. Generally, the invention comprises a mounting table for supporting the book. A rotatable shaft is mounted, preferably perpendicularly, to and through said table. A means for rotating the shaft is provided and preferably mounted to the table.

An elongated arm is mounted to the shaft for rotation therewith. The arm is mounted in a plane which is perpendicular to said table, but spaced apart therefrom. A cam means is provided which is pivotably mounted at one of its ends to the table and is biased so that its other end is normally spaced away from the table. The cam means is positioned for intersection with the arm, during the latter's rotation, for movement towards the table.

A page lifting means is positioned on the cam means adjacent the end spaced from the table. The lifting means contacts a portion of a page, typically an upper corner, when the rotating arm intersects the cam means to force it towards the table. As the arm disengages the cam means, the arm end with the lifting means is biased away from the table thereby lifting the end of the page. As the arm continues to rotate, it interposes itself between the lifted and unlifted underlying page of the book and turns the lifted page during the final rotation of the arm.

In a preferred embodiment, the rotating arm is movably positioned on the rotating shaft to accommodate books of various thicknesses and sizes. Preferably, the arm is of a length sufficient to scribe an arc that passes under the page lifting means. Also, the relative positioning of the shaft, cam means and arm is preferably such that the arm intersects the cam means along a section of the arm which is close to the shaft to facilitate overcoming the lifting bias of cam means.

Consequently, any number of leaves may be sequentially turned, and no preliminary set-up work is required, except to open the volume to the desired starting point and position it relative to the present invention. The movement of the elongated arm is conveniently controllable by electrical and/or electronic facilities at positions remote from the open volume, e.g., by a musician's foot or knee, and mechanical simplicity is provided. Other advantages of the present invention will become apparent from a perusal of the following detailed description of a presently preferred embodiment taken in connection with the accompanying drawings.

DESCRIPTION OF THE PREFERRED EMBODIMENTS

Figure 1:
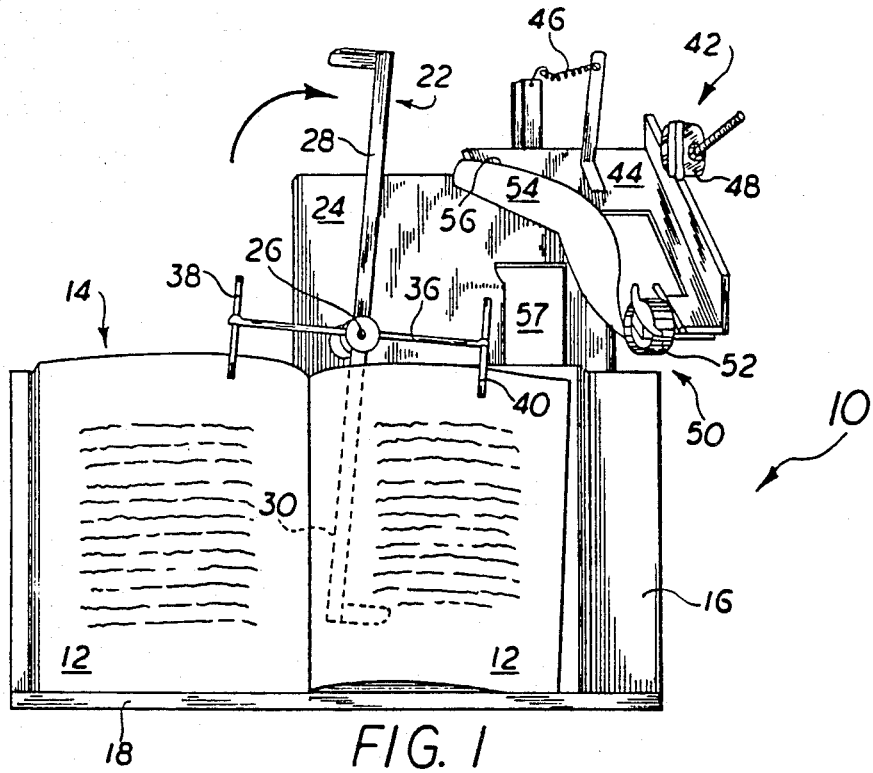
FIG. 1 is a perspective view of the front portion of a page turning device of the present invention, in a position at the beginning of the page turning cycle thereof.

With reference to FIGS. 1–4, there is shown a page turning device 10 for turning the leaves 12 of an open volume 14. Although not limiting to the invention, page turning device 10 may include table means for supporting the volume, e.g., a support face 16 and a support ledge 18 upon which the volume 14 may be conveniently rested. A hingably secured support bracket 20 may be conveniently positioned on the rear of support face 16 to hold the support face 16 in any desired inclination from the vertical. (see FIG. 4) Alternatively, the invention may be practiced utilizing a conventional music stand or piano stand to support the music or volume.

With continued reference to FIGS. 1–4, a first elongated arm member 22 is mounted to plate 24 on shaft 26 adjacent to the center region of the support face 16 to rotate through a circular path which is substantially parallel to but above the plane of the volume 14 on support face 16. As shown in the Figures, arm member 22 may conveniently include elongated portions 28 and 30 extending outwardly on opposite sides of shaft 26, with elongated portions 28 and 30 including slidably adjustable transverse fingers 32 and 34, respectively, at suitable locations therealong. In a manner which will be more apparent from later discussion, elongated portions 28 and 30 serve to alternately turn individual leaves of volumes 14.

Although not limiting to the invention, device 10 may also include a second elongated arm 36 mounted to shaft 26 spaced above and extending in a direction transverse to first elongated arm 22. Second elongated arm 36 is shorter in length than first elongated arm 22 and includes a pair of exposed hold-down members 38 and 40 at distal ends thereof, to hold the top leaf of volume 14 in a viewable position until turning is effected. First and second elongated arms 22 and 36 are each vertically adjustable in position on shaft 26 to accomodate volumes of different thickness.

Page turning device 10 further includes a lifting means 42 which functions to lift individual leaves of volume 14 near their free end to a predetermined elevated position above the plane of volume 14, and above the position of the elongated portions 28 and 30 as they sweep through that portion of their circular path which is above volume 14. Lifting facility 42 may include a pivotable bracket arm 44 hingably mounted to plate 24 and preferably extending over the end portions of the leaves of volume 14 when lowered thereto. A spring 46 secured between bracket arm 44 and plate 24 and a stop member 48 maintains bracket arm 42 in a rest position spaced from volume 14.

A leaf-securing element 50 is mounted at the end of bracket arm 44 to engage, lightly secure and lift sequential leaves of volume 14 when the bracket arm 44 is urged downwardly theretoward. Leafsecuring element 50 may take a wide variety of forms, including a magnetic member or a vacuum-actuated member. However, in a preferred embodiment of the invention, leaf-securing element 50 takes the form of an endless, rotatably mounted belt 52 having a selected adhesive material thereon which lightly adheres to all known paper materials and releases therefrom under appropriate urging without leaving a residue. Preferably a resilient cushion is positioned inside endless belt 52 to facilitate proper pressure contact between endless belt 52 and leaves of volume 14.

The choice of a suitable adhesive material is somewhat critical to the embodiment that employs the rotatably mounted belt 52 as the top leaf lifting means. One type of paper tape which is well suited to use in the preferred embodiment is a particular Scotch Brand tape sold by the 3M Company of St. Paul, Minn., under the trademark Post-It Cover-Up tape and notepads. The chemical composition of the particular bonding agent is proprietary to that firm, but this tape requires no liner while coiled as purchased and when adapted to serve as a lifting belt. It first adheres firmly to the text page when rolled thereon, but will separate just as readily when the arm 30 sweeps below the topmost page beyond the area where the belt 52 can normally remain in adhesive contact with the leaf 12. Other commercially available glues could be applied to paper tapes to achieve the same objective. The criterion for use will be that they function within the parameters just defined as leaf lifting and separation.

Figure 3:
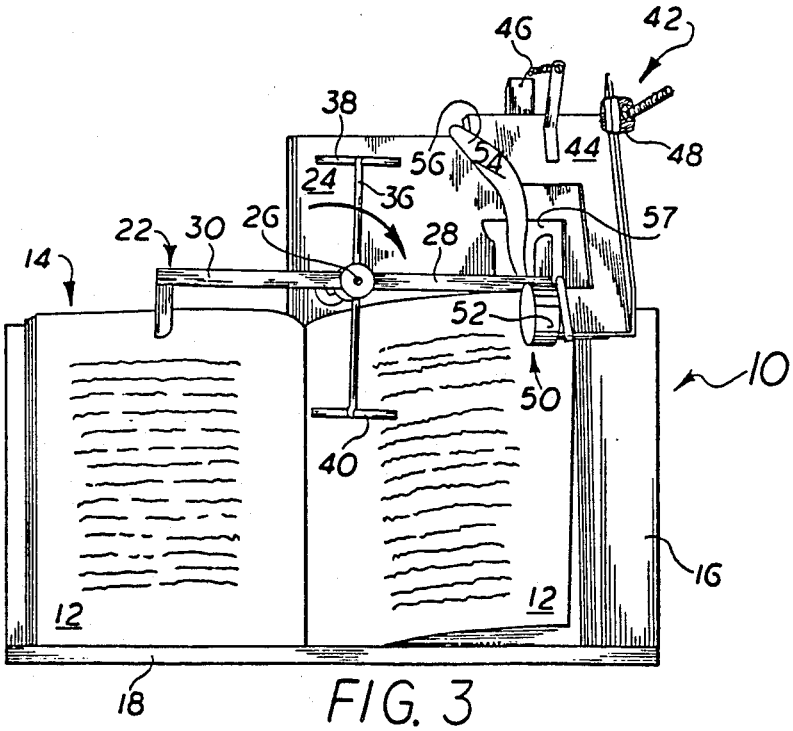
FIG. 3 is a view similar to the view of FIG. 1, showing the page turning device in a position near the end of the page turning cycle.

In the embodiment of the invention shown in FIGS. 1–4, a cam member 54 is secured to pivotable bracket arm 44 and controls the movement thereof by its interaction with elongated portions 28 and 30. More particularly and with reference to FIG. 2, as elongated portion 28 or 30 travels through its circular path in a clockwise direction, elongated portion 28 or 30 engages the cam surface 56 of cam member 54 and forces bracket arm 44 (and leaf-securing element 50) toward the volume 14 against the biasing force of spring 46. Leaf-securing element 50 engages and lightly secures the top leaf of volume 14 as elongated portion 28 or 30 moves up cam surface 56. In this orientation, a portion of cam member 54 extends through a window 57 in the plate 24. As elongated portion 28 or 30 passes the apex of cam surface 56, the spring 46 urges the bracket arm 44 away from volume 14 and leafsecuring element 50 lifts the top leaf of volume 14 to an elevation determined by stop member 48. As elongated arm 22 continues its arcuate movement, elongated portion 28 or 30 travels between the elevated top leaf and the underlying leaves of volume 14. As the arcuate motion continues, elongated portion 28 or 30 engages the underside of the top leaf and exerts sufficient force thereto to overcome the light hold of leaf-securing member 50. As elongated portion 28 or 30 approaches the centerline of volume 14, one of hold-down members 38 and 40 moves into position over the top leaf to maintain same in a conveniently observable position. Continued arcuate motion turns the top leaf about the centerline of volume 14 and uncovers a fresh leaf for viewing by the user. As shown in FIG. 3, transverse fingers 38 and 40 serve to hold previously turned pages in an open position and thereby avoid the tendency of recently turned pages to flip back of their own accord or under windy or drafty conditions.

As can be now appreciated, the rotary motion of arm member 22 actuates and controls the movement of the lifting facility 42. The rotary motion of arm member 22 may be conveniently energized by an electrical motor 60 which may be attached to the rear of plate 24 to drive shaft 26. The operation of motor 60 may conveniently controlled from a remote control device 62, e.g., a push button or switch, positioned conveniently for the user, e.g., for foot actuation by a musician. Preferably, motor 60 is selected to provide arm member 22 with a controlled sweep of arcuate motion upon each actuation, to occur at a controlled, relatively slow rate. For example, motor 60 can be selected to provide 180° of arcuate motion for arm member 22 such that either elongated portion 28 or 30 can complete one leaf-turning cycle before coming to rest to await the next actuation of motor 60. With reference to FIG. 1, it is preferable to control motor 60 to start and stop arm member 22 at a predetermined starting position, in which one of elongated portions 28 or 30 is positioned under the top leaf to be turned, adjacent the centerline of volume 14. In this starting position, elongated portion 28 or 30 is in position to immediately turn the top leaf upon actuation of motor 60, while hold-down member 38 or 40 holds the free end of the top leaf down loosely for convenient viewing.

Figure 2:
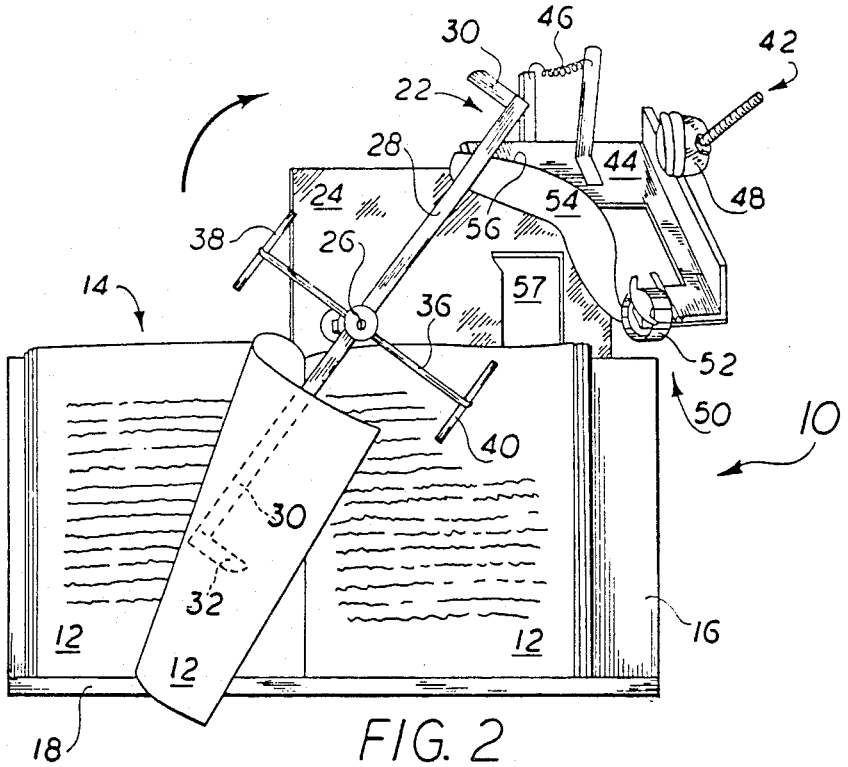
FIG. 2 is a view similar to the view of FIG. 1, showing the page turning device in an intermediate position in the page turning cycle.
Figure 4:
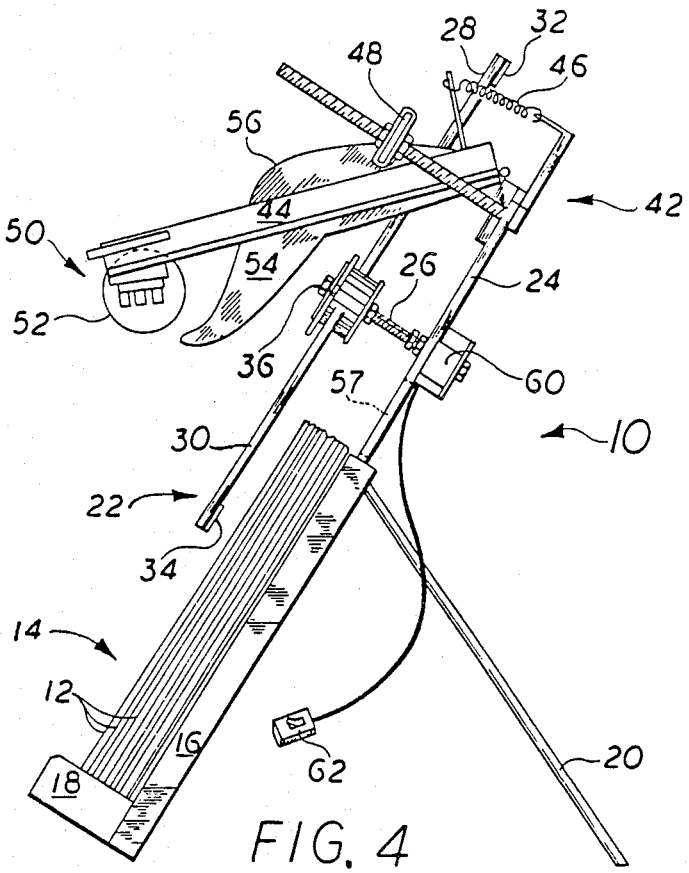
FIG. 4 is a side elevation of the page turning device shown in FIG. 1.

As shown in FIG. 2, upon actuation of motor 60, elongated portion 28 or 30 rotates to flip the top leaf while the opposing elongated portion begins to move along cam surface 56 of cam member 54 to actuate lifting facility 42. As shown in FIG. 3, continued rotation of elongated portion 28 or 30 along cam surface 56 lowers and then raises leaf-securing element 50 with the newly-uncovered top sheet and the elongated portion moves thereunder. As shown in FIG. 1, motor 60 is de-actuated when elongated portion 28 or 30 has continued to near the centerline of the volume 14, and hold-down member 38 or 40 has moved into position to loosely retain the top leaf for convenient viewing. Thus, 180° of rotation of shaft 26 results in one complete cycle of page turning, with actual turning of the top leaf occuring at the beginning of the cycle so that a musician need not actuate motor 60 prior to playing to the end of the music on a sheet.

Of course, the present invention is not intended to be limited to the specific embodiments of the invention described above. For example, cam member 54 may be conveniently replaced by electrical timing and solenoid elements, whereby actuation of the remote control device 62 will activate motion of motor 60 and at the appropriate time, also activates an electrical solenoid which will lower and then raise the bracket arm 44 to lift the top leaf of volume 14. In like manner, electrical timing elements may be conveniently incorporated into the operation of the present invention to activate a vacuum-actuated leaf-securing member 50 which can draw a top leaf upward from the volume 14 without requiring movement of a bracket arm 44.

A second embodiment of the invention which is particularly well suited for turning pages of a text of sheet music and books is depicted in FIGS. 5 through 8. If there is little or no chance that turned pages will flip backward of their own accord, the transverse finger or second elongated arm 36 of FIG. 1 may be omitted. The operation of the page lifting facility of this embodiment is mechanically simplier than that described above.

Figure 5:
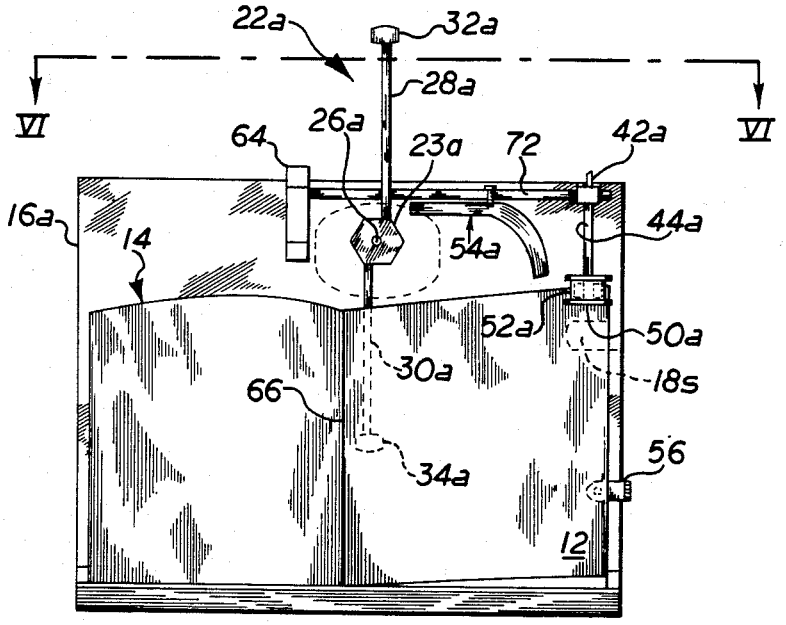
FIG. 5 is a front elevation view of the front portion of another embodiment of the page turning device seen in its position at the beginning of the page turning cycle.

Referring to FIG. 5, elongated arm member **22*a* is centrally anchored to shaft 26*a*, by mounting means 23*a*. Shaft 26*a* is rotatably mounted through inclined support table surface 16*a*, preferably at its upper central face. Arm 22*a* is adapted to rotate clockwise in a circular path parallel to and spaced above the plane of volume 14 lying on surface 16*a*. Arm 22*a* comprises two diametrically opposing extensions 28*a* and 30*a* extending from mounting beam 23*a* and terminating in cylindrical knobs 32*a* and 34*a***, respectively. The primary function of the extensions has been disclosed in relation to those of the first embodiment.

In the second embodiment, the center line of the book is positioned on the table so as to be approximately perpendicular to the cam means and may be slightly displaced from the axis of the rotatable shaft. In this way the elongated arm is conveniently introduced between the upraised top leaf and the open volume and continues its arcuate motion to turn the top leaf from one side of the open volume to the other.

Lifting means **42*a* is somewhat different from that described above. It includes a pivotable rigid member 72 which incorporates cam means 54*a*, and which is pivotably or hingably mounted to support surface 16*a* via hinge or prior assembly 64 at the one end, and pinned to offsetting arm 44*a* at the other end. Leaf securing element 50*a* is mounted at the outer end of arm 44*a*, and comprises an endless adhesive belt 52*a*, entrained over rollers 51 rotable mounted to arm 44*a*. Belt 52*a* as shown in FIG. 5 is positioned to lightly engage and adheres to topmost portion of page 12. As shown in FIG. 5, Belt 52*a* engages page 12 until arm 30*a*** rotates to the opposing side of the open text. In this version, the belt is oriented parallel to the upper edge of the open top leaf; that it, at right angles when compared to the first embodiment.

Adjustable clamp 56 is anchored to the lower (or upper) right hand edge of table surface **16*a*. Adjustable clamp contacts, and retain in place, the back cover of the text after the book is properly positioned on the support table. Clamp 56 serves to preclude the entire text from drifting toward the left hand side of the support surface 16*a*, as could be induced by the clock-wise turning forces of rotating arms 28*a* and 30*a*** moving repetitively across the pages.

Figure 6:
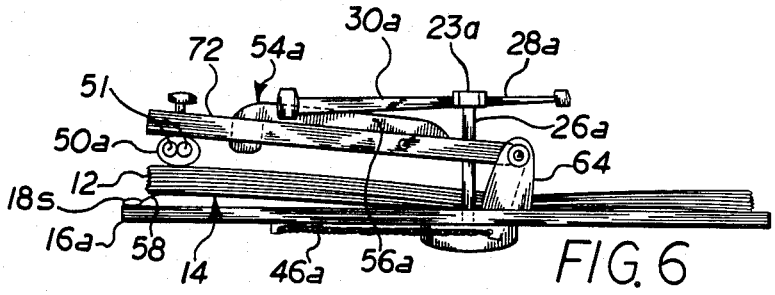
FIG. 6 is a top plan of the present invention, as seen along line VI—VI shown in FIG. 5; except that arm 22*a* has been rotated about 225° clockwise.
Figure 7:
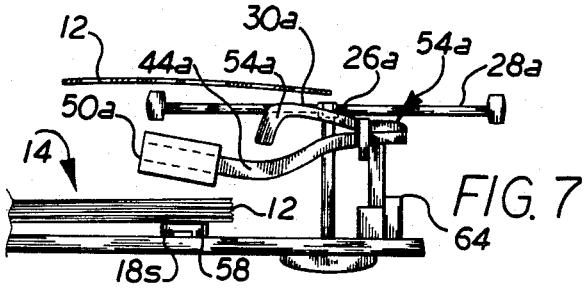
FIG. 7 is a rightside of the device shown in FIG. 5.

Now averting to FIG. 6, there is depicted a simple, upwardly biased leaf spring **18*s* anchored to the edge of the backside of the surface 16*a*, the spring serves to compensate with its upward bias for the gradually diminishing thickness of the stacked pages 12, as the page turning sequence proceeds well into the large text. The flexible leaf portion 58** would be interposed between the upper surface of the back cover and the lowermost of the stacked pages to be sequentially turned.

In operation, extensions **28*a* and 30*a* alternately engage cam surface 56*a* of cam member 54*a* forcing offset arm 44*a* downwardly until element 50*a* engages and lightly secures to the topmost leaf of page 12, while the arms 28*a* (or 30*a*) moves along the top of cam surface 54*a*. As the extension passes over the apex of cam surface 54*a*, the bias in arm 64 (provided via backside coiled spring 46*a*) urges the arm 44*a* upward from the volume face 14 while element 50*a* lifts the topmost leaf 12 as arm 30*a* crosses the center line 66** of the volume.

As elongated arm **22*a* continues in its circular path, extension 28*a* (or 30*a*) engage the underside of the topmost leaf exerting sufficient force to overcome the light adherence. The continuing circular motion flips the top leaf about the center line (as seen in FIG. 2), uncovering a fresh pair of pages to the viewer. Meanwhile, lifter 50*a* has swung back to the starting position, whereby endless belt 52*a* comes to rest above the new topmost leaf (as seen in FIG. 2**).

The rotary movement of member **22*a* is initiated, as earlier described by intermittent actuation, as the user so requires. Preferably, one contact of the central device 62 (FIG. 4**) is sufficient to cause one page turning (necessarily an 180° arcuate motion) until activated again.

It will be evident in this embodiment, that the page hold-down arm assembly (38, 40) has been omitted here for ease of viewing. However, its optional inclusion in this embodiment would be equally useful. It could vary from that depicted in FIGS. 1–4, in that it may be alternately hinged in the center of the shaft 26, with the hinge line substantially parallel to the rotor arms 38 and 40 so that they can lift over the cam 54*a* when the latter is in an upward position. This is now shown in FIGS. 9 and 10 which will be described.

Figure 8:
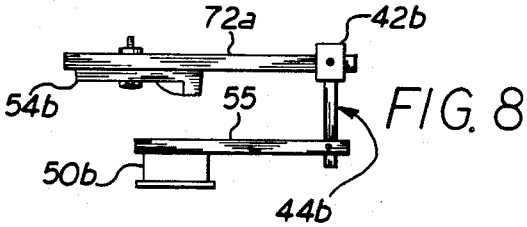
FIG. 8 is a of a Plan view of an alternative embodiment of arm 44b securing element 50B.

In the alternative embodiment of lifting means 42*a* shown in FIG. 8, it will be noted that offsetting arm 44*b* is pinned, at right angles, to another arm 55 which supports rotatable leaf securing element 50*b*. With regard to either of the arms 44*a* or 44*b*, they could advantageously be a leaf spring so as to accomodate text of various thicknesses. Rigid member 72*a* incorporates cam means 54*b* and is connected to arm 44*b*.

Figure 9:
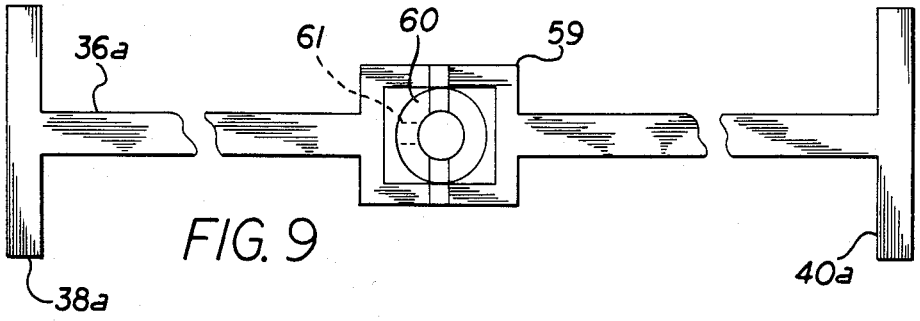
FIG. 9 is a top plan view of an alternate embodiment of the page hold-down arms shown in FIG. 1.
Figure 10:
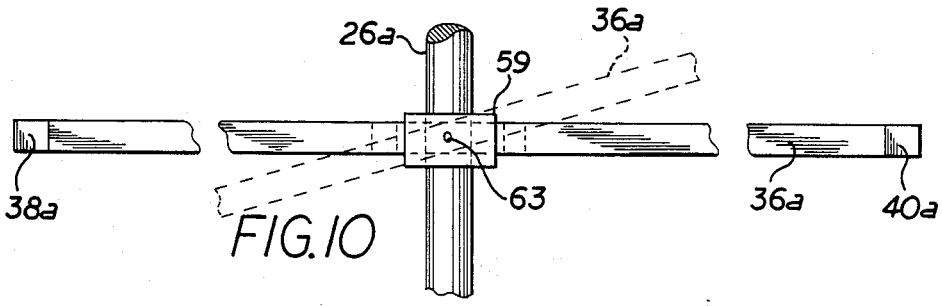
FIG. 10 is a side elevational view of the alternate embodiment of FIG. 9 depicting its hinged attachment to shaft 26*a* and showing support arm 36*a* both parallel to the support table 16*a* (not shown) and also in a phantom view, when it has been tilted in the course of the lifting over the camming arrangement.

Averting now to FIG. 9, hold down arm 36*a* is shown (partially broken away) with its distal end members 38*a* and 40*a*. Arm 36*a* is slipped over shaft 26*a* by its box-like central apperture 59. An annular collar 60 is positioned within opening 59 and is further provided with a cut-out portion 61 which is aligned about the shaft so as to permit lifting arm 30*a* to pass over the cam 54*a* (FIG. 5), tilting the latter arm so as not to effect a cam action as described above. This is shown in FIG. 10 in phantom. When the upward bias of the cam has been passed, arm 36*a* reverts to its normally horizontal position. A screw means 63 is provided to adjustably pin the collar assembly 60 to rotating shaft 26*a*.

Figure 11:
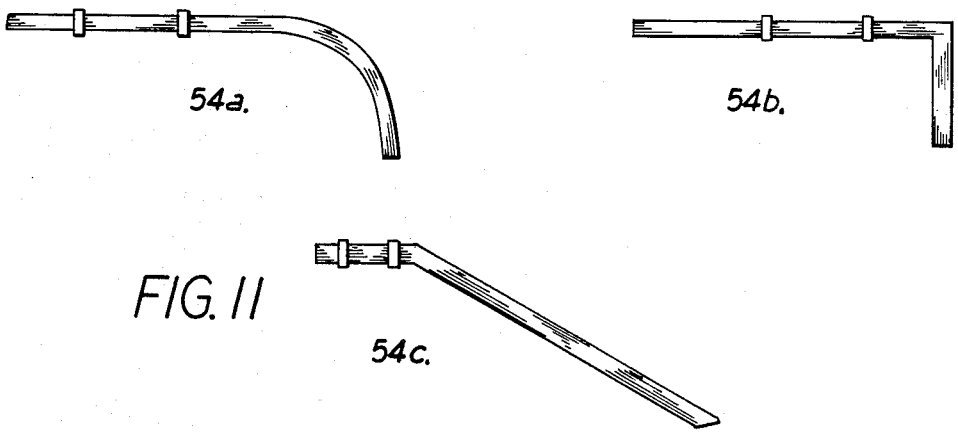
FIGS. 11*a, b* and *c* depict in plan elevation three isolated embodiments of the cam member 54*a* of FIG. 5.

In FIG. 11, there are shown three standing along embodiments 54*a* 54*b* and 54*c* of the cam member (11*a* being much like the one shown as assembled in FIG. 5), which may also usefully be employed in this invention. Each of these cams provides a slightly different regimen for lifting means 50*a* in terms of the time or compression placed by said means on the page.

In a preferred mode of operation, microswitches (not shown) are positioned about shaft 26*a* for interrupting the rotational cycle of the shaft. This has been found useful, for example, in turning the pages of sheet music where arm 30*a* is positioned under the sheet of lifted music and stopped as shown in FIG. 5, then by manually activating the start of rotation, the page is immediately turned at the desired time in the score. Obviously, other control means can be used to actuate the rotation of the shaft.

With regard to the paperback form of book, another feature can be added to the support face 16 (FIGS. 1 to 9), which will broaden the scope of the invention. Such would be to modify face 16 under the area of book support by a rectangular cut-out, which would be replaced by a flexing panel that would be hinged linearly just above support ledge 18 (not shown). This would pivot (retract) downwardly for a relatively thick paperback type of book. Since this novel feature provides for flexing below the support surface, it will permit this embodiment to accomodate texts of practically any thickness. This alternate construction takes the place of spring 18*s* in the embodiment of FIGS. 6 and 7.

It is also to be understood that the present invention, while of great advantage and usefulness to musicians, is not intended to be limited to such use, for comparable advantage will be realized by disabled individuals. Accordingly, the scope of the present invention is limited only by the claims which follow.

What is claimed is:

1. An apparatus for individually turning the pages of a book or other compilation of pages comprising:

a. a mounting table for supporting a book on its upper surface;

b. a rotatable shaft perpendicularly mounted through said table for rotation;

c. an elongated arm means mounted on and adapted for rotation with said shaft; said arm means being parallel to and spaced apart from said upper surface a distance sufficient to rotate over said pages;

d. a cam pivotally mounted to said table, said cam being biased away from the table and positioned for intersection with the elongated arm, said cam including biasing means;

e. means for lifting a page mounted to said cam ; and f. means for rotating said rotatable shaft in one direction only.

2. An apparatus for individually turning the pages of a book or other compilation of pages comprising:

a. a mounting table for supporting a book on its upper surface;

b. a rotatable shaft perpendicularly mounted through said table for rotation;

c. a cam, having a surface, pivotally mounted to said table, said cam being biased away from the table, said cam including biasing means;

d. means for lifting a page mounted to said cam;

e. an elongated arm means mounted on and adapted for rotation with said shaft and also adapted to contact and slide along said cam surface as the elongated arm means rotates causing said lifting means to contact a page; said arm means being parallel to and spaced apart from said upper surface a distance sufficient to rotate over said pages; and f. means for rotating said rotatable shaft in one direction only.

3. An apparatus for individually turning the pages of a book or other compilation of pages comprising:

a. a mounting table for supporting a book on its upper surface;

b. a rotatable shaft perpendicularly mounted through said table for rotation;

c. an elongated arm means mounted on and adapted for rotation with said shaft, said arm means being parallel to and spaced apart from said upper surface a distance sufficient to rotate over said pages;

d. a cam, having a surface and an end, pivotally mounted to said table, said cam being biased away from the table, said cam including biasing means, said cam end terminating before the beginning of a book's upper edge such that there is space at least equal to the width of the elongated arm means between the cam end and the upper edge of said book, said cam surface adapted to allow said elongated arm means to contact and slide along said cam surface as the elongated arm means rotates;

e. means for lifting a page mounted to said cam in such a way that said lifting means contacts a page as said elongated arm means slides along said cam surface; and f. means for rotating said rotatable shaft in one direction only.

4. An apparatus as claimed in claim 1, 2 or 3, wherein said lifting means includes a belt having an adhesive coating thereon and mounted for rotation.

5. An apparatus as claimed in claim 1, 2 or 3, wherein said elongated arm is adjustably mounted to said shaft to provide sufficient space to rotate over said pages.

6. An apparatus as claimed in claim 1, 2, 3, 4 or 5, wherein said means for rotating said shaft includes control means having positioning switches to stop and start rotation in synchronization with the turning of a page.

7. An apparatus as claimed in claim 1, 2 or 3, wherein said elongated arm includes a second arm mounted at the respective centers at right angles, said second arm being adapted to avoid contact with said cam.

8. An apparatus as claimed in claim 1, 2 or 3, including means mounted to said upper surface of said mounting table for biasing said book in the direction of the lifting means.

* * * * *